US009033669B2

(12) United States Patent
Giri et al.

(10) Patent No.: US 9,033,669 B2
(45) Date of Patent: May 19, 2015

(54) ROTATING AIRFOIL COMPONENT WITH PLATFORM HAVING A RECESSED SURFACE REGION THEREIN

(75) Inventors: Sheo Narain Giri, Karnataka (IN); Harish Bommanakatte, Karnataka (IN); Mohankumar Banakar, Karnataka (IN); John David Ward, Jr., Woodruff, SC (US); Jonathan Matthew Lomas, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 532 days.

(21) Appl. No.: 13/524,026

(22) Filed: Jun. 15, 2012

(65) Prior Publication Data

US 2013/0336801 A1 Dec. 19, 2013

(51) Int. Cl.
*F01D 5/14* (2006.01)

(52) U.S. Cl.
CPC ..... *F01D 5/143* (2013.01); *F01D 5/147* (2013.01); *F05D 2240/80* (2013.01)

(58) Field of Classification Search
CPC ..... F01D 5/14; F01D 5/141; F01D 5/143; F05D 2240/301; F05D 2240/80
USPC ..... 416/193 A
See application file for complete search history.

(56) References Cited

U.S. PATENT DOCUMENTS

| | | | | |
|---|---|---|---|---|
| 6,805,534 | B1 | 10/2004 | Brittingham | |
| 7,134,842 | B2 * | 11/2006 | Tam et al. | 416/193 A |
| 7,217,096 | B2 * | 5/2007 | Lee | 416/97 R |
| 7,708,528 | B2 | 5/2010 | Couch et al. | |
| 8,206,115 | B2 * | 6/2012 | Gupta et al. | 416/193 A |
| 8,439,643 | B2 * | 5/2013 | Kuhne et al. | 416/193 A |
| 8,647,067 | B2 * | 2/2014 | Pandey et al. | 416/223 R |
| 2007/0020102 | A1 | 1/2007 | Beeck et al. | |
| 2010/0040460 | A1 | 2/2010 | Spangler et al. | |
| 2010/0158696 | A1 | 6/2010 | Pandey et al. | |
| 2011/0044818 | A1 | 2/2011 | Kuhne et al. | |
| 2013/0224027 | A1 * | 8/2013 | Barr et al. | 416/193 A |

* cited by examiner

*Primary Examiner* — Ninh H Nguyen
(74) *Attorney, Agent, or Firm* — Ernest G. Cusick; Gary M. Hartman; Michael D. Winter

(57) ABSTRACT

A rotating airfoil component of a turbomachine, in which the component has an airfoil aligned in a spanwise direction of the component, a shank, and a platform therebetween oriented transverse to the spanwise direction. The platform has an outer radial surface adjacent the airfoil, and at least one recessed region defined in its outer radial surface. The recessed region extends opposite the spanwise direction from a platform plane that contains portions of the outer radial surface that are upstream and downstream from the recessed region. The recessed region is contiguous with an end wall of the platform and extends therefrom toward the airfoil. The recessed region defines a surface shape whose boundary is contained by the platform plane, and has a profile shape that extends from the end wall toward the airfoil. The recessed region is sized and shaped to increase the stiffness of the platform.

18 Claims, 4 Drawing Sheets

ROTATING AIRFOIL COMPONENT WITH PLATFORM HAVING A RECESSED SURFACE REGION THEREIN

BACKGROUND OF THE INVENTION

The present invention generally relates to rotating airfoil components of gas turbines and other turbomachinery. More particularly, this invention relates to turbine airfoil components having platforms configured to increase radial stiffness and reduce compressive stresses therein.

Buckets (blades) and nozzles (vanes) are examples of components that are located in the hot gas path within turbine sections of gas turbines. Whereas nozzles are static components, buckets are rotating components mounted to a rotor wheel within the turbine section to convert the thermal energy of the hot combustion gas to mechanical energy.

As a nonlimiting example, FIG. 1 schematically represents a bucket 10 of a land-based gas turbine engine of a type used in the power generation industry. As represented in FIG. 1, the bucket 10 comprises an airfoil 12 extending from a shank 14. The bucket 10 is further represented as being equipped with a dovetail 16 formed on its shank 14 by which the bucket 10 can be conventionally anchored to a rotor wheel (not shown) as a result of being received in a complementary slot defined in the circumference of the wheel. The dovetail 16 is conventionally configured to be of the "axial entry" type, in which the dovetail 16 has "fir tree" shape adapted to mate with a complementary-shaped dovetail slot in a rotor wheel. The airfoil 12 of the bucket 10 is directly subjected to the hot gas path within the turbine section of a gas turbine engine. The bucket 10 is also represented as having a platform 18 that forms a portion of the radially inward boundary of the hot gas path and, consequently, experiences very high thermal loads. Other relatively conventional features of the bucket 10 include sealing flanges ("angel wings") 19 that project axially away from the forward and aft ends of the shank 14.

Buckets (and blades) of gas turbines are typically formed of nickel-, cobalt- or iron-base superalloys with desirable mechanical and environmental properties for turbine operating temperatures and conditions. Because the efficiency of a gas turbine is dependent on its operating temperatures, there is a demand for components that are capable of withstanding increasingly higher temperatures. As the maximum local temperature of a component approaches the melting temperature of its alloy, forced air cooling becomes necessary. For this reason, airfoils of gas turbine buckets often require complex cooling schemes in which air is forced through internal cooling passages within the airfoil and then discharged through cooling holes at the airfoil surface.

The high thermal loads to which the platform 18 is subjected are also detrimental to component life. In particular, high thermal loads can result in bulging and excessive deformation of the platform 18, leading to the possibility of low cycle fatigue (LCF) and creep failure. One form of platform deformation is schematically represented in FIG. 2, which shows a fragmentary view of the platform region of the bucket 10. As shown in FIG. 2, deformation of the platform 18 can result in a bulge 22 in the radially outermost (upper) surface 20 of the platform 18. The bulge 22 projects in a spanwise direction (indicated by an arrow in FIG. 2) of the bucket 10, which corresponds to the direction that the airfoil 12 extends from the platform 18. Because hot combustion gas flows across the platform surface 20 (also indicated by an arrow in FIG. 2), the bulge 22 can result in a downstream vortex that results in performance loss. To reduce thermal loads and their detrimental consequences, conventional practice is to employ a cooling scheme for the shank 14 and platform 18 of the bucket 10, often in the form of a cooling air flow obtained by air bled from the compressor section (not shown) of the engine. However, this purge flow is costly to the overall performance of a turbine engine, and therefore any reduction in the cooling air flow would be advantageous to turbine efficiency.

In view of the above, it would be desirable if the tendency and extent of deformation of bucket platforms could be reduced without requiring any further increase in cooling air flow.

BRIEF DESCRIPTION OF THE INVENTION

The present invention provides a rotating airfoil component of a turbomachine, in which the component has an airfoil portion aligned in a spanwise direction of the component, a shank portion, and a platform therebetween oriented transverse to the spanwise direction. The platform is configured to exhibit increased stiffness in the spanwise direction of the component for the purpose of reducing deformation of and stresses in the platform during operation of the turbomachine.

According to a first aspect of the invention, the platform has an outer radial surface adjacent the airfoil portion and an inner radial surface adjacent the shank portion and oppositely-disposed from the outer radial surface. The outer radial surface is adapted to define a radially inward boundary of a gas flow path when the component is installed in a turbomachine so as to be subjected to gas flow flowing through the turbomachine in a flow direction of the turbomachine. A cross-section of the platform is defined by and between the outer and inner radial surfaces in the spanwise direction. The platform is further delimited by oppositely-disposed first and second end walls, each between and contiguous with the outer and inner radial surfaces and approximately aligned with the flow direction. At least a first recessed region is defined in the outer radial surface of the platform. The first recessed region extends in a shank direction opposite the spanwise direction from a platform plane that contains an upstream portion of the outer radial surface in an upstream direction from the first recessed region opposite the flow direction and also contains a downstream portion of the outer radial surface in the flow direction from the first recessed region. The first recessed region is contiguous with the first end wall and extends therefrom toward the airfoil portion. The first recessed region defines a surface shape when viewed in the shank direction, and defines a profile shape that is transverse to the flow direction and extends from the first end wall toward the airfoil portion.

According to a particular aspect of the invention, the rotating airfoil component may be a bucket of a land-based gas turbine engine. According to another particular aspect of the invention, the inner radial surface of the platform has a complementary portion having a profile shape that is complementary to the profile shape of the first recessed region, so that the cross-section of the platform between the first recessed region and the complementary portion has an approximately uniform thickness.

A technical effect of the invention is that the recessed region of the platform serves to increase the radial stiffness of the platform and, in doing so, is capable of reducing stresses and deformation in the platform during the operation of the turbomachine. The beneficial effects of the recessed region can be readily tailored to address thermal and dynamic loading of the platform associated with the particular design requirements of the bucket.

Other aspects and advantages of this invention will be better appreciated from the following detailed description.

DETAILED DESCRIPTION OF THE INVENTION

Figure 1:
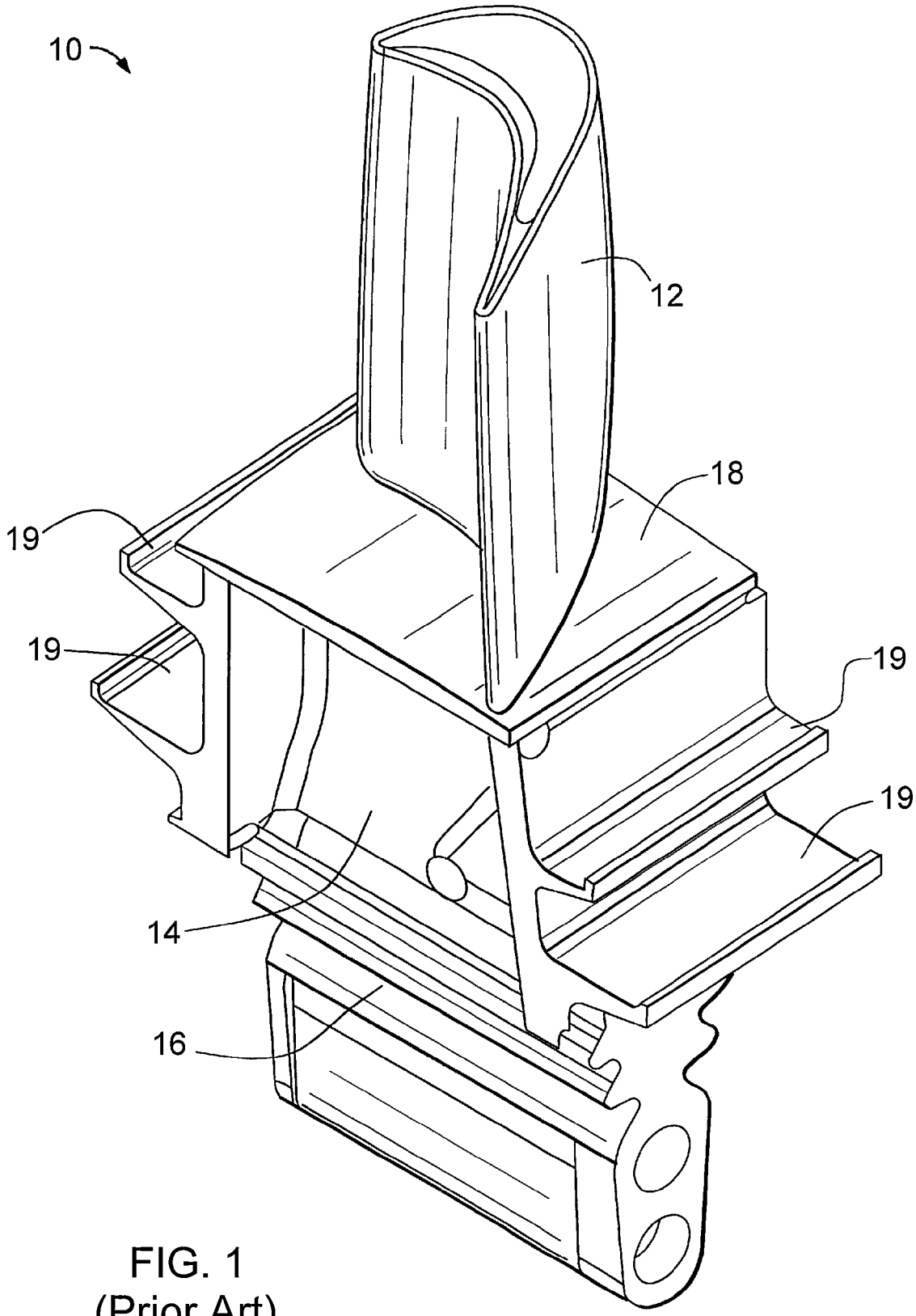
FIG. 1 (Prior Art)
FIG. 1 is a perspective view of a turbine bucket.

FIGS. 3 through 8 schematically represent views of embodiments of a platform region of a rotating airfoil component. For convenience, the invention will be described below in reference to the bucket 10 depicted in FIG. 1, and as such consistent reference numbers will used throughout the drawings to identify the same or functionally equivalent elements as those identified with reference to FIG. 1. However, it should be appreciated that the invention is not limited to buckets of land-based gas turbine engines, and instead is more broadly applicable to rotating airfoil components of turbomachines.

Figure 2:
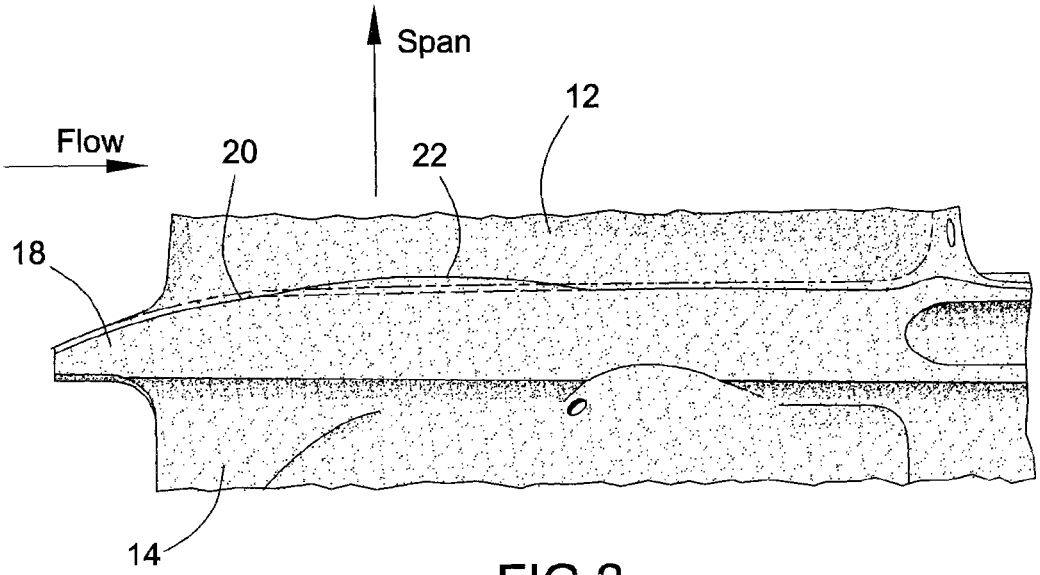
FIG.2 Prior Art
FIG. 2 is a fragmentary side view of a platform region of the bucket of FIG. 1, and represents deformation in a platform of the bucket resulting from a high thermal load.
Figure 3:
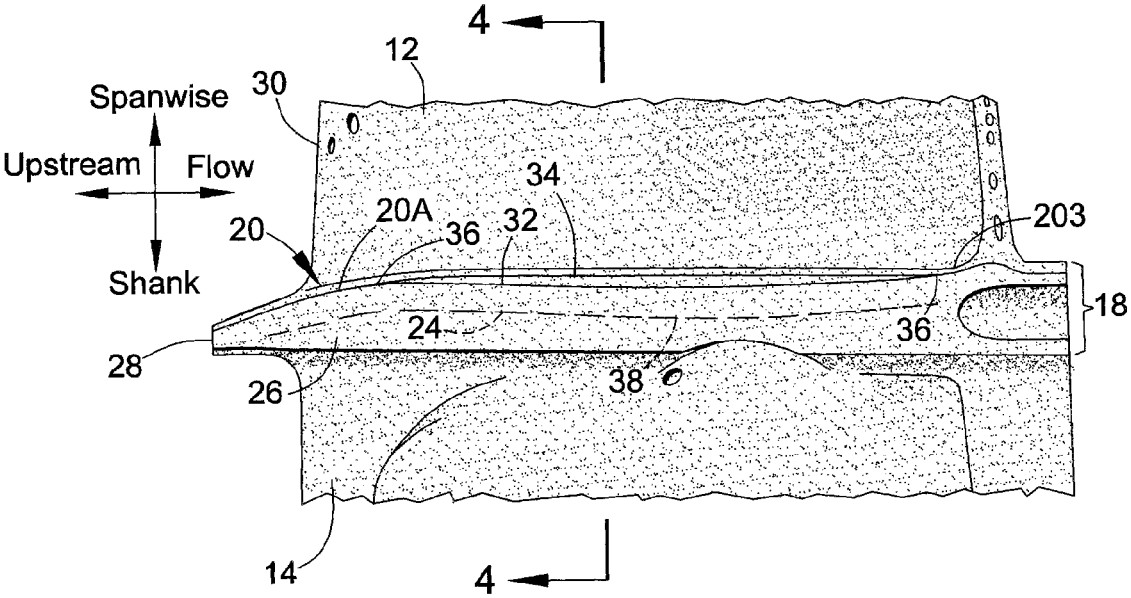
FIG. 3 is a fragmentary side view of a platform region of a bucket similar to what is shown in FIG. 2, but represents the platform as having an outer radial surface modified in accordance with an embodiment of the invention.

On the basis of the above, FIG. 3 can be understood to represent a platform region of the bucket 10, and observed from a viewpoint similar to FIG. 2. Furthermore, the bucket 10 includes an airfoil 12 aligned in the spanwise direction of the bucket 10, a shank 14, and platform 18 therebetween. For convenience, the shank 14 will be described as extending in a shank direction of the bucket 10 that is opposite the spanwise direction, which are both represented by arrows in FIG. 3. Furthermore, the platform 18 can be seen as oriented transverse to the spanwise and shank directions, and roughly parallel to a flow direction (also indicated by an arrow in FIG. 3) in which hot combustion gas flows across an outer radial surface 20 of the platform 18. As such, the outer radial surface 20 defines a radially inward boundary of the gas flow path within the turbine section of the engine, and is therefore directly subjected to hot combustion gas flow. The platform 18 is represented as also having an inner radial surface 24 that is adjacent the shank 14 and oppositely-disposed from the outer radial surface 20, such that the outer and inner radial surfaces 20 and 24 define a cross-section therebetween in the spanwise direction. Finally, FIG. 3 also shows an end wall 26 of the platform 18 that is between and contiguous with the outer and inner radial surfaces 20 and 24. In addition, the end wall 26 is approximately aligned with the flow direction. It should be understood that the platform 18 also has another end wall (not shown) that is oppositely-disposed from the end wall 26 seen in FIG. 3. In this configuration, the dovetail 16 of the bucket 10 is configured to be installed in an axial dovetail slot of a turbine wheel (not shown).

The bucket 10 and its features can be conventionally formed of nickel-, cobalt-, or iron-based superalloys of types suitable for use in gas turbines. Notable but nonlimiting examples include nickel-based superalloys such as GTD-111® (General Electric Co.), GTD-444® (General Electric Co.), IN-738, René™ N4 (General Electric Co.), René™ N5 (General Electric Co.), René™ 108 (General Electric Co.) and René™ N500 (General Electric Co.). The bucket 10 may be formed as equiaxed, directionally solidified (DS), or single crystal (SX) castings to withstand the high temperatures and stresses to which it is subjected within a gas turbine engine. It is also within the scope of the invention for the bucket 10 to be formed of a ceramic matrix composite (CMC) material, non-limiting examples of which include CMC materials whose reinforcement and/or matrix are formed of Si-containing materials, such as silicon, silicon carbide, silicon nitride, metal silicide alloys such as niobium and molybdenum silicides.

As can be seen in FIG. 3, the outer radial surface 20 of the platform 18 is tapered near its leading edge 28, which roughly coincides with a leading edge 30 of the airfoil 12. Downstream of the leading edge 28 (in the flow direction), the outer radial surface 20 of the platform 18 is more planar, in other words, roughly parallel to the flow direction. However, an important exception is a recessed region 32 that, as seen in FIG. 3, extends in the shank direction from what will be referred to herein as a platform plane 34. The platform plane 34 is defined herein as a plane that contains at least upstream and downstream portions 20A and 20B of the outer radial surface 20. As represented in FIG. 3, the upstream portion 20A is located in an upstream direction (indicated in FIG. 3) relative to the recessed region 32, in other words, in the opposite direction of the flow direction. Furthermore, the downstream portion 20B of the outer radial surface 20 is located downstream of the recessed region 32, in other words, in the flow direction. The recessed region 32 is contiguous with the end wall 26 (FIGS. 4 through 8) and extends from the wall 26 toward, though not necessarily to, the airfoil 12, in which case the platform plane 34 also contains a portion 20C of the outer radial surface 20 adjacent the airfoil 12. As evident from FIG. 3. The entire recessed region 32 is offset from (below) the platform plane 34.

According to a preferred aspect of the invention, the recessed region 32 serves to promote the radial stiffness of the platform 18, and in so doing is able to reduce deformation of and stresses in the platform 18 so that a bulge (FIG. 2) will not or at least is less likely to occur when the bucket 10 is subjected to the high thermal and dynamic loads associated with its operating conditions within the turbine section of a turbomachine. As will be discussed in reference to FIGS. 4 and 5, the cross-sectional shape of the recessed region 32 is continuous but can be arcuate and concave or can be more planar (at an acute angle to the platform plane 34). As indicated in FIG. 3 and seen from FIGS. 6 through 8, the recessed region 32 defines a surface shape when viewed in the shank direction that has a boundary 36 contained by the platform plane 34. Furthermore, as can best be seen from FIGS. 4 and 5, the recessed region 32 defines a profile shape that is transverse to the flow direction and defined by the contour of the recessed region 32 as it extends from the end wall 26 toward the airfoil 12.

Figure 4:
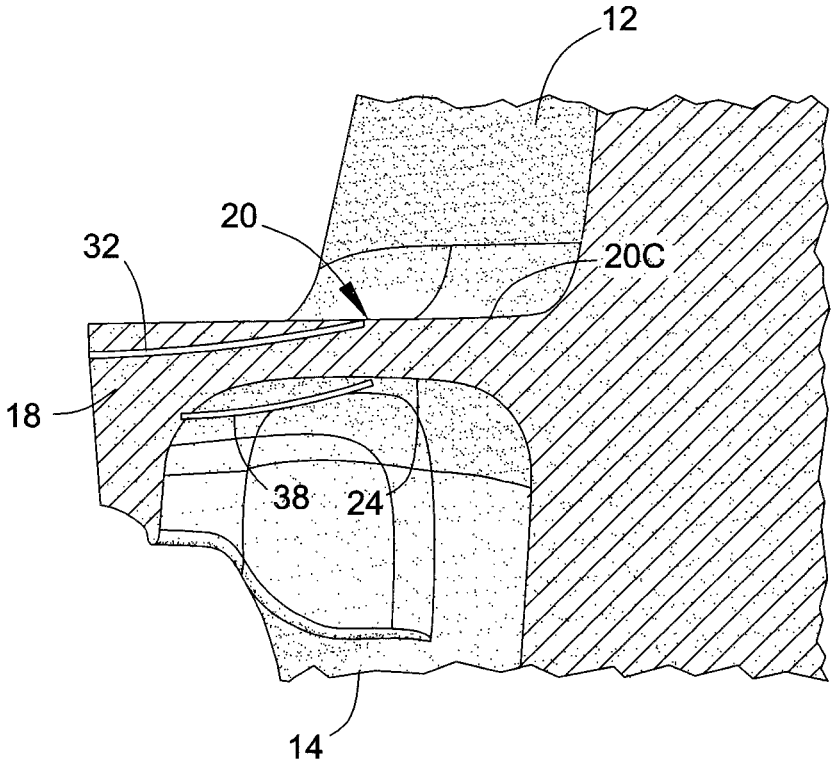
FIGS. 4 and 5 are fragmentary cross-sectional views taken along section line 4-4 of FIG. 3, and show two alternative configurations for cross-sectional profiles of the modified platform.
Figure 5:
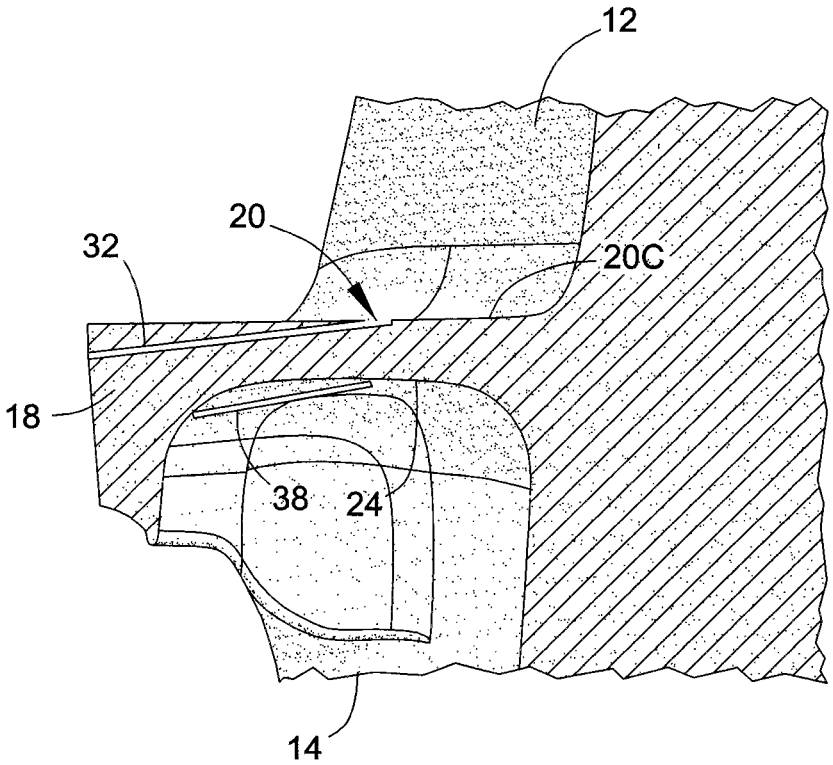

As generally indicated in FIG. 3 and shown more particularly in FIGS. 4 and 5, the inner radial surface 24 defines a region 38 that is preferably complementary to the recessed region 32 in the outer radial surface 20. More particularly, the complementary region 38 has a profile shape that is preferably complementary to the profile shape of the recessed region 32 so that the cross-section of the platform 18 therebetween has an approximately uniform thickness, in other words, varies by no more than conventional casting/machining tolerances. In FIG. 4, the profiles of the recessed and complementary regions 32 and 38 are both continuous and arcuate, with the recessed region 32 having a concave shape and the region 38 having a complementary convex shape. On the other hand, FIG. 5 represents the profiles of the recessed and complementary regions 32 and 38 are being continuous but planar, such that the surfaces of the recessed and complementary regions 32 and 38 are substantially parallel to each other.

It should be understood that the profiles of the recessed and complementary regions 32 and 38 are not limited to the examples shown in FIGS. 4 and 5, for example, a recessed region 32 that is more or less concave than what is shown and a complementary region 32 that is more or less convex than what is shown are also within the scope of the invention. In particular, the profiles of the recessed and complementary regions 32 and 38 can be tailored according to the thermal and dynamic loads to which the bucket 10 will be subjected during the operation of a turbomachine in which the bucket 10 is installed. As such, the maximum extent of the recessed region 32 from the platform plane 34 can vary. Generally, a maximum extent of at least 20% of the platform cross-sectional thickness (defined herein as the distance between the outer and inner radial surfaces 20 and 24) is believed to be necessary to significantly increase the radial (spanwise) stiffness of the platform 18. A particular example of a suitable range for this purpose is believed to be about 20% to about 100% of platform thickness, and a more preferred range is believed to be about 40% to 80% of platform thickness. Analytical studies of an existing bucket design predicted that a concave-shaped recessed region with a maximum extent of about 100 mils (about 2.5 mm) may be capable of sufficiently reducing deformation and resultant compressive stresses to improve LCF life by about 20% or more. Furthermore, the analyzed design was also predicted to reduce deformation to the extent that downstream vortex would not occur, thereby also predicting an improvement in aero performance for the bucket.

Figure 6:
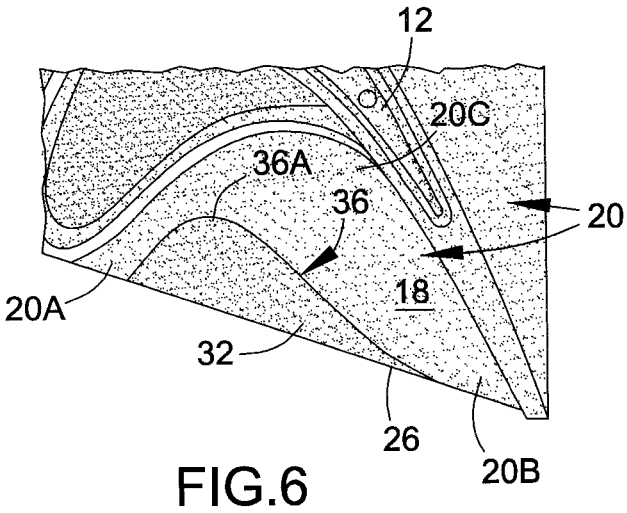
FIGS. 6, 7 and 8 are fragmentary plan views of the outer radial surface of the platform of FIG. 3, and show three alternative configurations for surface shapes of the modified platform.
Figure 7:
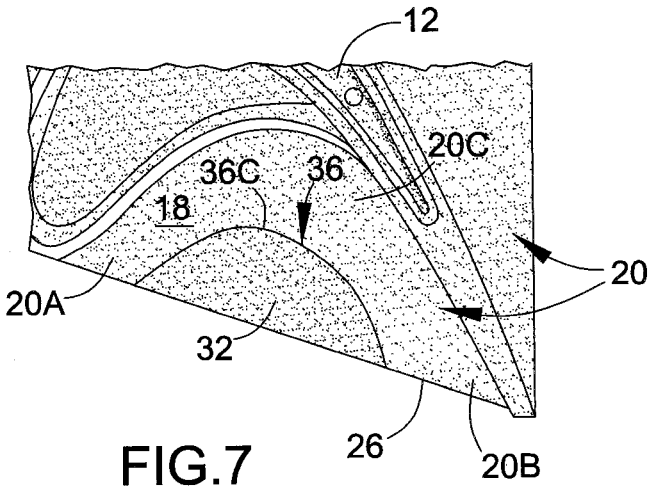
Figure 8:
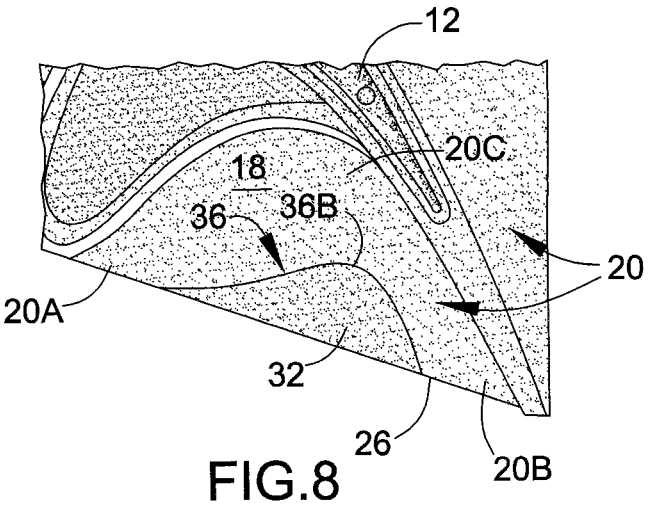

Referring now to FIGS. 6 through 8, a fragment of the airfoil 12 and platform 18 are shown as viewed in the shank direction of the bucket 10. From FIGS. 6 through 8, the surface shape of the recessed region 32 and its boundary 36 are indicated. The embodiments of FIGS. 6 through 8 differ in the overall shape of the boundary 36 of the recessed region 32. In FIG. 6, an upstream portion 36A of the boundary 36 extends farthest from the end wall 26 near the upstream portion 20A of the outer radial surface 20. In contrast, FIGS. 7 and 8 represent, respectively, a midportion 36C and a downstream portion 36B of the boundary 36 as extending farthest from the end wall 26. In view of FIGS. 6 through 8, it should be appreciated that the size and shape of the recessed region 32 and, correspondingly, the complementary region 38 of the inner radial surface 24 can also be tailored to increase the stiffness of the platform 18. Depending on the loading conditions and corresponding life requirements of the bucket 10, an optimum configuration can be selected from these shapes, as well as variations thereof.

While FIGS. 3 through 8 and the descriptions thereof refer to the presence of a recessed region 32 in the platform 18 on only one side of the airfoil 12, it should be understood that the area of the platform 18 on the opposite side of the airfoil 12 can be similarly configured. In other words, the platform 18 can be formed to have a second recessed region in the outer radial surface 20 of the platform 18 and a second complementary region in the inner radial surface 24 of the platform 18, with the airfoil 12 located between these additional recessed and complementary regions and the regions 32 and 38 shown in FIGS. 3 through 8. Preferably, the second recessed region extends in the shank direction from the platform plane 34, and is contiguous with opposite end wall and extends therefrom toward the airfoil 12.

While the invention has been described in terms of specific embodiments, it is apparent that other forms could be adopted by one skilled in the art. For example, the physical configuration of the recessed region 32 and its complementary region 38 could differ from that shown, as could the overall configuration of the bucket. Therefore, the scope of the invention is to be limited only by the following claims.

The invention claimed is:

1. A rotating airfoil component of a turbomachine, the component comprising an airfoil portion aligned in a spanwise direction of the component, a shank portion, and a platform therebetween oriented transverse to the spanwise direction, the platform comprising:

an outer radial surface adjacent the airfoil portion, the outer radial surface being adapted to define a radially inward boundary of a gas flow path when installed in the turbomachine so as to be subjected to gas flow in a flow direction when installed in the turbomachine;

an inner radial surface adjacent the shank portion and oppositely-disposed from the outer radial surface;

a cross-section between the outer and inner radial surfaces in the spanwise direction;

oppositely-disposed first and second end walls, each of the end walls being between and contiguous with the outer and inner radial surfaces and approximately aligned with the flow direction; and at least a first recessed region in the outer radial surface, the first recessed region extending in a shank direction opposite the spanwise direction from a platform plane that contains an upstream portion of the outer radial surface in an upstream direction from the first recessed region opposite the flow direction and also contains a downstream portion of the outer radial surface in the flow direction from the first recessed region, the first recessed region being contiguous with the first end wall and extending therefrom toward the airfoil portion, the first recessed region defining a surface shape when viewed in the shank direction, the first recessed region defining a profile shape transverse to the flow direction and extending from the first end wall toward the airfoil portion, wherein the profile shape of the first recessed region is a continuous planar profile shape extending from the first end wall toward the airfoil portion.

2. The rotating airfoil component according to claim 1, wherein a complementary portion of the inner radial surface has a profile shape that is complementary to the profile shape of the first recessed region so that the cross-section of the platform between the first recessed region and the complementary portion has an approximately uniform thickness.

3. The rotating airfoil component according to claim 1, wherein the profile shape of the first recessed region is a continuous arcuate concave profile shape extending from the first end wall toward the airfoil portion.

4. The rotating airfoil component according to claim 3, wherein a complementary portion of the inner radial surface has a continuous arcuate convex profile shape that is complementary to the continuous arcuate concave profile shape of the first recessed region so that the cross-section of the platform between the first recessed region and the complementary portion has an approximately uniform thickness.

5. The rotating airfoil component according to claim 1, wherein a complementary portion of the inner radial surface has a continuous planar profile shape that is complementary to the continuous planar profile shape of the first recessed region so that the cross-section of the platform between the first recessed region and the complementary portion has an approximately uniform thickness.

6. The rotating airfoil component according to claim 1, wherein the surface shape of the first recessed region has a boundary contained by the platform plane, and the boundary extends farthest from the first end wall at an upstream boundary portion that is located adjacent the upstream portion of the outer radial surface.

7. The rotating airfoil component according to claim 1, wherein the surface shape of the first recessed region has a boundary contained by the platform plane, and the boundary extends farthest from the first end wall at an intermediate boundary portion that is located intermediate the upstream and downstream portions of the outer radial surface.

8. The rotating airfoil component according to claim 1, wherein the surface shape of the first recessed region has a boundary contained by the platform plane, and the boundary extends farthest from the first end wall at a downstream boundary portion that is located adjacent the downstream portion of the outer radial surface.

9. The rotating airfoil component according to claim 1, wherein the first recessed region has a maximum extent from the platform plane of 20% to 100% of a cross-sectional thickness of the platform.

10. The rotating airfoil component according to claim 1, further comprising a second recessed region in the outer radial surface, the airfoil portion being between the first and second recessed regions, the second recessed region extending in the shank direction from the platform plane, the second recessed region being contiguous with the second end wall and extending therefrom toward the airfoil portion.

11. The rotating airfoil component according to claim 1, wherein the component is a turbine bucket of a land-based gas turbine engine.

12. A bucket of a land-based gas turbine engine, the bucket comprising an airfoil portion aligned in a spanwise direction of the bucket, a shank portion, and a platform therebetween oriented transverse to the spanwise direction, the platform comprising:

an outer radial surface adjacent the airfoil portion, the outer radial surface being adapted to define a radially inward boundary of a gas flow path when installed in the gas turbine engine so as to be subjected to gas flow in a flow direction when installed in the gas turbine engine;

an inner radial surface adjacent the shank portion and oppositely-disposed from the outer radial surface;

a cross-section between the outer and inner radial surfaces in the spanwise direction;

oppositely-disposed first and second end walls, each of the end walls being between and contiguous with the outer and inner radial surfaces and approximately aligned with the flow direction;

at least a first recessed region in the outer radial surface, the first recessed region extending in a shank direction opposite the spanwise direction from a platform plane that contains an upstream portion of the outer radial surface in an upstream direction from the first recessed region opposite the flow direction, a downstream portion of the outer radial surface in the flow direction from the first recessed region, and a portion of the outer radial surface between the first recessed region and the airfoil portion, the first recessed region being contiguous with the first end wall and extending therefrom toward the airfoil portion, the first recessed region defining a surface shape when viewed in the shank direction, the surface shape having a boundary contained by the platform plane, the first recessed region defining a profile shape transverse to the flow direction and extending from the first end wall toward the airfoil portion; and a complementary portion of the inner radial surface, the complementary portion having a profile shape that is complementary to the profile shape of the first recessed region so that the cross-section of the platform between the first recessed region and the complementary portion has an approximately uniform thickness, wherein the profile shape of the first recessed region is a continuous planar profile shape extending from the first end wall toward the airfoil portion, and the complementary portion of the inner radial surface has a continuous planar profile shape that is complementary to the continuous planar profile shape of the first recessed region so that the cross-section of the platform between the first recessed region and the complementary portion has an approximately uniform thickness.

13. The bucket according to claim 12, wherein the profile shape of the first recessed region is a continuous arcuate concave profile shape extending from the first end wall toward the airfoil portion and the complementary portion of the inner radial surface has a continuous arcuate convex profile shape that is complementary to the continuous arcuate concave profile shape of the first recessed region so that the cross-section of the platform between the first recessed region and the complementary portion has an approximately uniform thickness.

14. The bucket according to claim 12, wherein the boundary of the surface shape of the first recessed region extends farthest from the first end wall at a upstream boundary portion that is located adjacent the upstream portion of the outer radial surface.

15. The bucket according to claim 12, wherein the boundary of the surface shape of the first recessed region extends farthest from the first end wall at an intermediate boundary portion that is located intermediate the upstream and downstream portions of the outer radial surface.

16. The bucket according to claim 12, wherein the boundary of the surface shape of the first recessed region extends farthest from the first end wall at a downstream boundary portion that is located adjacent the downstream portion of the outer radial surface.

17. The bucket according to claim 12, wherein the first recessed region has a maximum extent from the platform plane of 20% to 100% of a cross-sectional thickness of the platform.

18. The bucket according to claim 12, further comprising a second recessed region in the outer radial surface, the airfoil portion being between the first and second recessed regions, the second recessed region extending in the shank direction from the platform plane, the second recessed region being contiguous with the second end wall and extending therefrom toward the airfoil portion.

* * * * *

UNITED STATES PATENT AND TRADEMARK OFFICE

CERTIFICATE OF CORRECTION

PATENT NO. : 9,033,669 B2
APPLICATION NO. : 13/524026
DATED : May 19, 2015
INVENTOR(S) : Giri et al.

It is certified that error appears in the above-identified patent and that said Letters Patent is hereby corrected as shown below:

In the specification,

In Column 4, Line 38, delete "FIG. 3. The" and insert -- FIG. 3, the --, therefor.

Signed and Sealed this
Third Day of November, 2015

Michelle K. Lee

Michelle K. Lee
*Director of the United States Patent and Trademark Office*